United States Patent [19]

Courson

[11] 4,425,603

[45] Jan. 10, 1984

[54] INDIRECT LIGHT-DISTRIBUTING CEILING FIXTURES WITH ALTERNATE REFLECTOR ARRAY

[75] Inventor: Iber C. Courson, Gettysburg, Pa.

[73] Assignee: Westinghouse Electric Corp., Pittsburgh, Pa.

[21] Appl. No.: 282,981

[22] Filed: Jul. 14, 1981

[51] Int. Cl.[3] ..... F21V 23/02

[52] U.S. Cl. ..... 362/222; 362/297; 362/307; 362/346; 362/408

[58] Field of Search ..... 362/148, 404, 224, 222, 362/145, 408, 217, 150, 349, 327, 347, 346, 342, 362/290, 292, 297, 307, 279

[56] References Cited

U.S. PATENT DOCUMENTS

| | | | |
|---|---|---|---|
| Re. 27,125 | 5/1971 | Steel | 362/279 X |
| 1,929,020 | 10/1933 | Exelmans | 362/327 X |
| 2,724,047 | 11/1955 | Zurawski | 362/292 |
| 2,887,567 | 5/1959 | Dameral | 362/217 X |
| 3,124,310 | 3/1964 | Lipscomb | 362/342 |
| 3,246,138 | 4/1966 | Florence | 362/217 |
| 3,798,443 | 3/1974 | Bartenbach | 362/148 |
| 3,860,829 | 1/1975 | Fabbri | 362/148 X |
| 4,059,754 | 11/1977 | Lewin | 362/342 |
| 4,186,433 | 1/1980 | Baldwin | 362/408 X |
| 4,268,897 | 5/1981 | Schierwagen et al. | 362/342 X |

FOREIGN PATENT DOCUMENTS

| | | | |
|---|---|---|---|
| 830684 | 2/1952 | Fed. Rep. of Germany | 362/217 |
| 814354 | 6/1959 | United Kingdom | 362/224 |

*Primary Examiner*—Richard E. Schafer
*Assistant Examiner*—John S. Maples
*Attorney, Agent, or Firm*—D. R. Lackey

[57] ABSTRACT

An indirect light-distributing ceiling structure having a plurality of light reflector members disposed in spaced horizontal relation near a light-reflective ceiling. The light reflector members have a triangular cross-sectional configuration, with alternate reflector members being oriented to provide a horizontal surface facing the ceiling, and with the intervening reflector members being inverted. A source of light is mounted on the horizontal surface of at least one of the alternate reflector members.

9 Claims, 6 Drawing Figures

INDIRECT LIGHT-DISTRIBUTING CEILING FIXTURES WITH ALTERNATE REFLECTOR ARRAY

BACKGROUND OF THE INVENTION

1. Field of the Invention

The invention relates in general to illuminating ceiling structures, and more specifically to light-distributing ceiling structures of the indirect type.

2. Description of the Prior Art

Light-distributing ceiling structures conventionally utilize a grid, a plastic panel, or some other form of decorative drop ceiling, disposed between a light source and an area to be illuminated. The light source may be one or more fluorescent lighting fixtures, for example. While these prior art arrangements usually provide pleasing results, it would be desirable to be able to utilize a less costly lighting arrangement, if the aesthetics are not unduly sacrificed. Less costly light-distributing ceiling structures of the prior art are usually much less attractive, however, and are not utilized when it is essential that the lighting arrangement be aesthetically pleasing.

SUMMARY OF THE INVENTION

Briefly, the present invention is a new and improved indirect light-distributing ceiling structure which includes a plurality of inexpensive, hollow, reflector members having a triangular cross-sectional configuration. These reflective members are disposed in spaced, parallel relation adjacent to a light-reflective ceiling. A pair of elongated, Z-shaped mounting brackets support the ends of the reflector members. Alternate reflector members have an apex of the triangular configuration facing downwardly to provide a horizontal support surface facing the ceiling. The intervening reflector members are inverted, such that a horizontal surface of the triangular configuration faces downwardly towards the area to be illuminated. A light source is disposed on the support surface of at least one of the alternate reflector members, and usually two or more light sources are used, disposed on different support surfaces, as required in order to obtain the desired illumination of the area below. Thus, the usual rectangular support frame is not required, and the costly grid, plastic sheet, or drop ceiling, is eliminated. The reflector members are dimensioned and spaced such that the light sources are not directly viewable from below, i.e., all illumination below the ceiling structure is indirect, being reflected from the ceiling and from the sides of the reflector members. Further substantial cost savings are obtainable in a preferred embodiment of the invention wherein at least one pair of lamp holders is mounted on the upper side of the support surface, and the ballast is supported on the other side, with the associated reflector member thus functioning as the lighting fixture and housing for the electrical components and associated wiring.

BRIEF DESCRIPTION OF THE DRAWING

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

Figure 1:
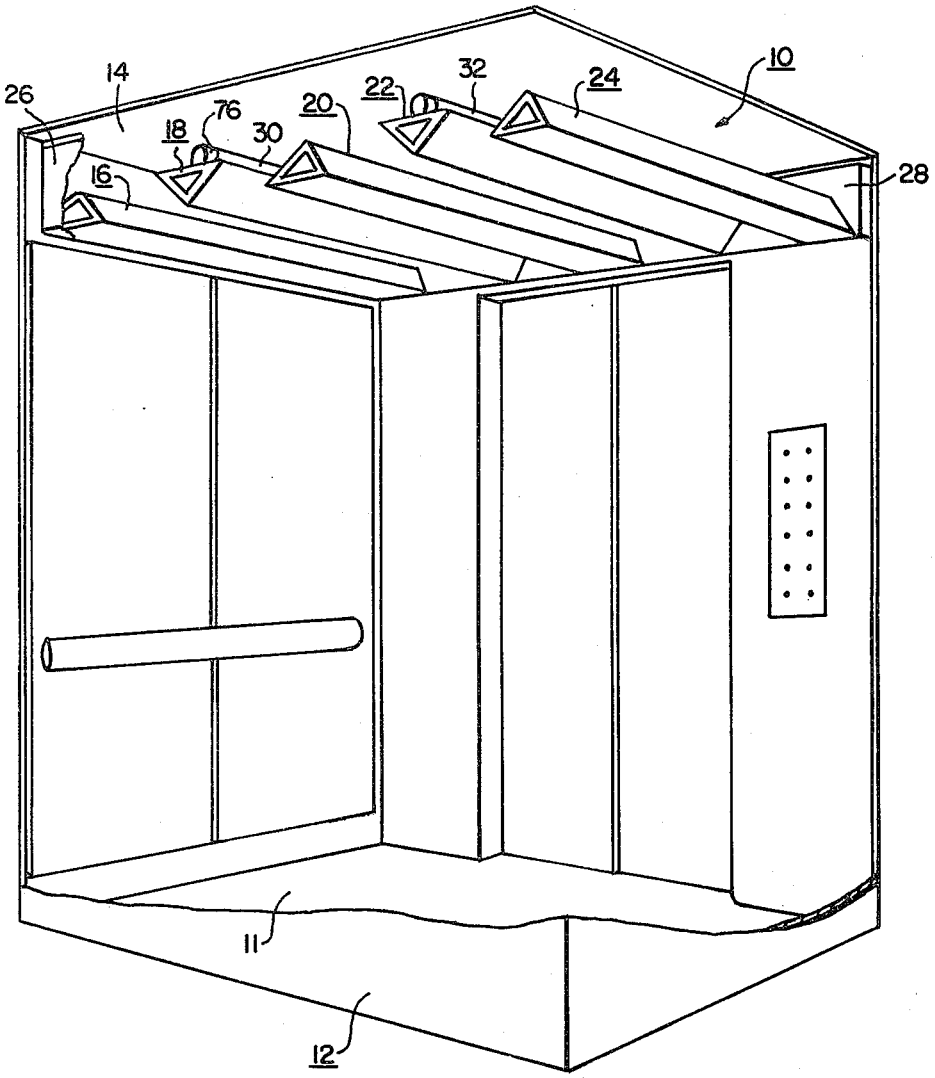
FIG. 1 is a perspective view of an indirect light-distributing ceiling structure constructed according to the teachings of the invention.

Referring now to the drawings, and to FIG. 1 in particular, there is shown an indirect light-distributing ceiling structure 10 constructed according to the teachings of the invention. Ceiling structure 10 is illustrated illuminating the floor area 11 and interior of an elevator cab 12, but the invention is not to be limited to this specific application. Ceiling structure 10 includes a ceiling 14 having a light-reflective surface, such as a ceiling made of wood or metal having a smooth, or crinkled, reflective surface or film on the base surface. For example, the ceiling 14 may be painted with a white paint. In the exemplary application shown in FIG. 1, ceiling 14 is the ceiling of the elevator cab 12.

Ceiling structure 10 further includes a plurality of elongated reflector members, with five reflector members 16, 18, 20, 22 and 24 being shown for purposes of example. Each of the reflector members has first, second and third major light-reflective surfaces arranged to define a hollow enclosure having a triangular cross-sectional configuration. The reflector members may be formed of a very thin metal, such as 0.025″ thick or 0.032″ thick steel or aluminum, or the reflector members may be made of a suitable high-strength, light-reflective plastic material. The major surfaces of the reflector members, if metal, may be made light reflective with a smooth, or crinkled, film, such as white paint, or some other light-reflective surface may be used, such as a brushed stainless steel surface. The sides of the reflector members may be pierced, i.e., contain a large plurality of very small perforations, as desired, for decorative effect.

The plurality of reflector members are disposed in horizontally spaced relation with one another, and in vertically spaced relation below ceiling 14. The major support for the reflector members may be provided by first and second bracket members 26 and 28, respectively, which members support opposite ends of the elongated reflector members, as will be hereinafter described relative to the other Figures.

Alternate reflector members, such as reflector members 18 and 22 are oriented such that one of their major surfaces faces ceiling 14, and the remaining or intervening reflector members 16, 20 and 24 are inverted, compared with the orientation of the alternate reflector members, such that a major surface thereof faces the floor area 11, and the facing major surfaces of adjacent reflector members are in spaced parallel planes. In the elevator application shown in FIG. 1, the longitudinal axes of the reflector members preferably extend from the front to the back of the cab 12, but any orientation may be used.

The upwardly facing major surfaces of reflector members 18 and 20 provide support surfaces which may receive, or function as, lighting fixtures, having lamp holders for receiving fluorescent tubes or lamps. In the embodiment of FIG. 1, both reflector members 18 and 22 provide this function, including fluorescent lamps 30 and 32, respectively, but it is to be understood that all reflector members oriented with their major surfaces facing ceiling 14 do not have to support a light source.

The reflector members are dimensioned, and spaced from one another, such that the fluorescent lamps 30 and 32 are not directly viewable from below the ceiling structure. Thus, all of the light from fluorescent lamps 30 and 32 which illuminate the area below the ceiling structure 10 is indirect, being reflected from ceiling 14 and from the major surfaces of the reflector members. Discrete reflectors above each lamp are not required, or desired, as the ceiling 14 functions as a common reflector for all light sources.

Figure 2:
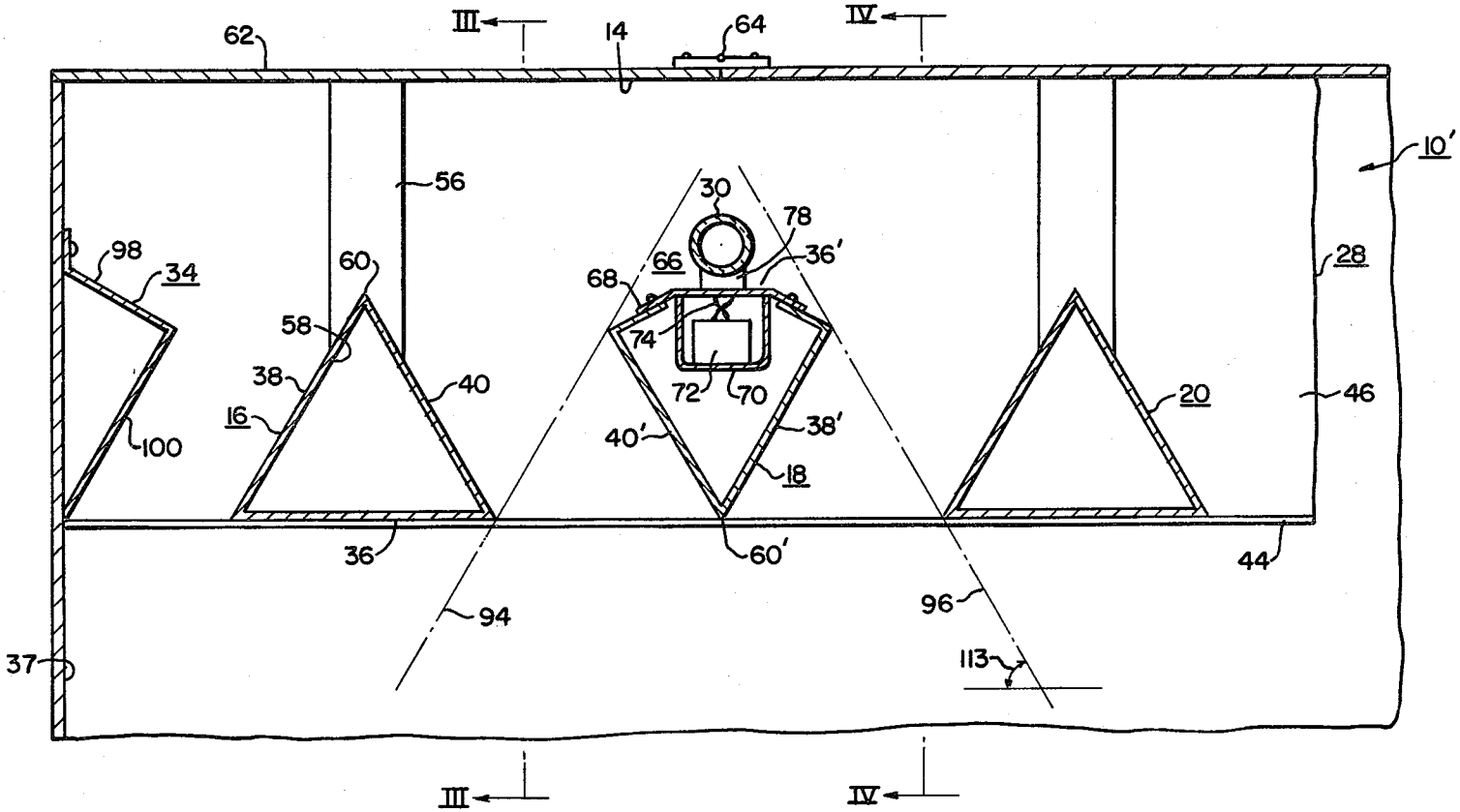
FIG. 2 is a fragmentary, elevational view, in section, of a light-distributing ceiling structure constructed according to the teachings of the invention.

FIG. 2 is a fragmentary, elevational view, in section, of an indirect light-distributing ceiling structure 10', which is similar to ceiling structure 10 shown in FIG. 1, except for the addition of a modified reflector member 34. Reflector member 34 is disposed at one lateral edge of the ceiling structure, and a like-configured member would be disposed at the opposite lateral edge thereof. Like elements in FIGS. 1 and 2 are given like reference numerals.

Figure 3:
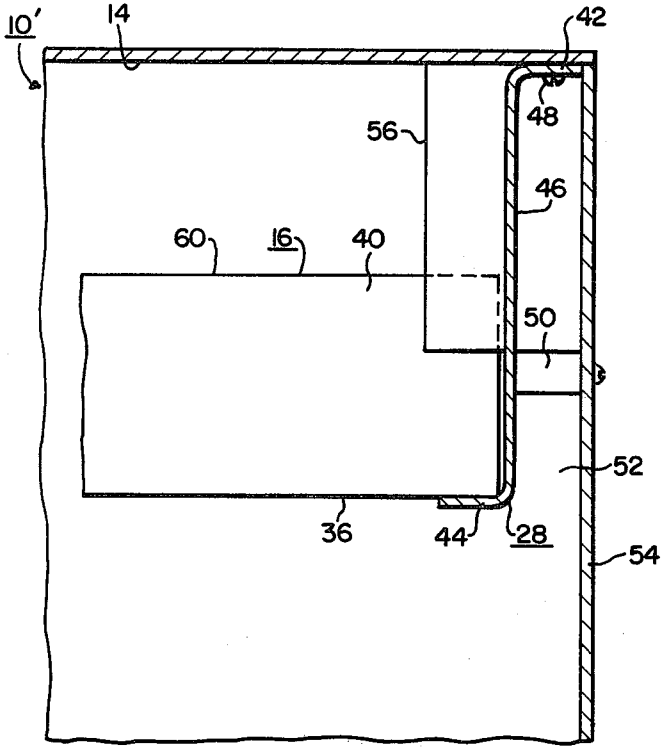
FIG. 3 is a side-elevational view of one of the reflector members shown in FIG. 2, taken between and in the direction of arrows III—III.

Reflector member 16 has first, second and third sides 36, 38 and 40, respectively, which in this embodiment have equal widths, such as 5 to 6 inches, for example. The equal width sides thus define an equilateral triangle. The opposite ends of reflector member 16 are supported by support members or brackets 26 and 28, as illustrated in FIG. 1. As illustrated most clearly in FIGS. 2 and 3, with FIG. 3 being a side-elevational view of reflector member 16 taken between and in the direction of arrows III—III in FIG. 2, the support members 26 and 28 may each have a substantially Z-shaped cross-sectional configuration. For example, support member 28 may have first and second horizontally oriented leg portions 42 and 44, respectively, interconnected by a vertical portion 46. Leg portions 42 and 44 are turned in opposite directions, with leg portion 44 defining a shelf for supporting first ends of the reflector members, and with leg portion 42 being disposed against ceiling 14. Suitable fasteners 48, such as screws, extend through openings in leg portion 42 and into ceiling 14, to fix support member 28 adjacent to ceiling 14. A plurality of spacer members, such as a spacer member 50, may be fixed in the space 52 between the vertical portion 46 of the support member 28 and the adjacent end wall 54.

The support members 26 and 28 provide sufficient support for reflector member 16. To prevent lateral movement of reflector member 16, its ends may be restrained by disposing a guide member at each end, such as guide member 56. Guide member 56 has a notch 58 in its lower end configured to snugly fit the upwardly extending apex 60 of reflector member 16, and the upper end of guide member 56 is suitably fixed to ceiling 14.

Ceiling 14 is illustrated in FIG. 2 as having an escape door 62 suitably hinged to the remaining portion of ceiling 14 via a hinged member 64. This illustrates where an escape door, required in an elevator application of the invention, may be placed when using a ceiling structure constructed according to the teachings of the invention.

Figure 4:
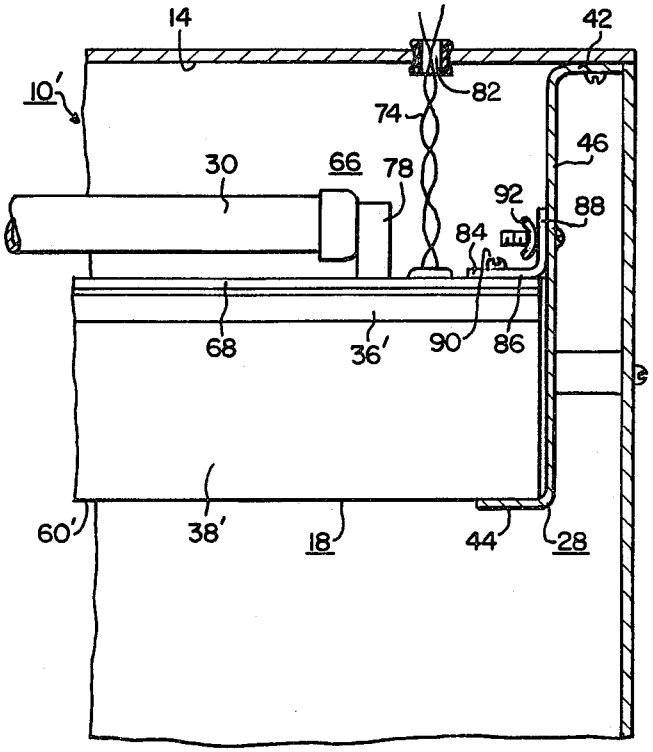
FIG. 4 is a side-elevational view of another of the reflector members shown in FIG. 2, taken between and in the direction of arrows IV—IV.

The next adjacent reflector member 18 in FIG. 2 is also shown in a side-elevational view in FIG. 4. FIG. 4 is taken between and in the direction of arrows IV—IV in FIG. 2. Reflector member 18 has first, second and third major sides or surfaces 36', 38' and 40', corresponding to the first, second and third major sides 36, 38 and 40, respectively, of reflector members 16. Reflector member 18 is inverted, i.e., rotated 180° about its longitudinal axis, compared with the orientation of reflector member 16, to cause its first major side 36' to face the ceiling 14, and its apex 60' to face the floor area 11.

The first major side 36' is modified to provide a support for at least one fluorescent lighting fixture 66. Fixture 66 includes an elongated base sheet or member 68, a housing 70 fixed to one side of member 68 for containing a ballast 72 and associated electrical wiring 74, and a pair of lamp holders is fixed to the opposite side of member 68, such as lamp holders 76 and 78. The first side 36' of member 18 may have an opening formed therein for receiving fixture 66, and suitable fasteners, such as screws, may be used to secure fixture 66 to the side 36' of reflector member 18. As illustrated in FIG. 2, the first major side 36' may be modified in any suitable manner to accommodate fixture 66, such as by increasing the angle between the first side 36 and each of the second and third sides 38' and 40'. The increasing of these specific angles provides sloping surfaces which will more readily shed debris tossed upwardly from below.

Figure 2A:
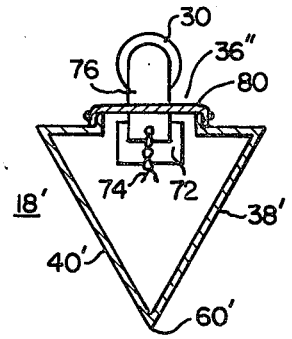
FIG. 2A illustrates another embodiment for certain of the reflector members shown in FIG. 2.

FIG. 2A is an end view of a reflector member 18', illustrating a modification of reflector 18 shown in FIG. 2. Instead of the reflector member being modified to accept a lighting fixture, in this embodiment the reflector member 18' functions as a lighting fixture. At least one pair of lamp holders 76 and 78 is fixed to one side of an elongated plate member 80, which is a portion of the first major side 36'', and the ballast 72 is fixed to the other side of plate member 80. Depending upon the length of the reflector member 18', additional lamp holders may be fixed to member 80, etc., to accommodate more than one fluorescent lamp per reflector. The enclosure 70 is eliminated in this embodiment, with the reflector member 18' itself functioning as the housing for the ballast 72 and associated electrical wiring 74. FIG. 2A also illustrates another arrangement for modifying the first major side, with an opening being formed therein which is defined by upturned flanges. Plate member 80 has cooperatively downturned flanges, which overlap the upwardly extending flanges of the first major side. Suitable fastener means may be used to secure the overlapped flanges together.

In either the embodiment of FIG. 2 or 2A, the wiring 74 is directed upwardly through an insulated opening in the first major side of reflector member 18, and then, as shown in FIG. 4, the wiring 74 may extend through an opening 82 in the ceiling 14. A quick connector (not shown) may be used to connect wiring 74 to a source of electrical potential.

Since the apex 60' of reflector member 18 rests upon the flanged portion of support brackets 26 and 28, additional support therefor is required in order to maintain this orientation. This additional support may be provided by first and second right angle bracket members, one at each longitudinal end of member 18, such as right angle bracket member 84. Member 84 has first and second leg portions 86 and 88, respectively, with leg portion 86 being fixed to the first major side or surface 36', and with leg portion 88 being fixed to the vertical portion 46 of Z-bracket 28, via suitable fasteners 90 and 92, respectively.

As shown by broken lines 94 and 96 in FIG. 2, which lines represent line of sight by a viewer standing on the floor area 11 below ceiling structure 10, the reflector members are spaced such that the adjacent edges of reflector members 16 and 20 prevent a line-of-sight view of fluorescent tube 30.

The addition of reflector member 34 shown in FIG. 2 illustrates that if the symmetry requires a reflector member to be placed directly against a side wall 36, its configuration may be different than the configuration of the intermediate reflector members. In other words, instead of using the same triangular configuration as the intermediate reflector members, which configuration would trap light if placed directly against the side wall portion, the side wall itself should be used to form one side of the triangular configuration. The other two sides of the triangular configuration, i.e., sides 98 and 100, are dimensioned and oriented the same as one-half of one of the intermediate reflector members, with the dividing line being a vertical plane disposed through the longitudinal axis of a reflector member. A reflector member similar to reflector member 34 would be disposed at the opposite lateral edge of ceiling structure 10'.

Figure 5:
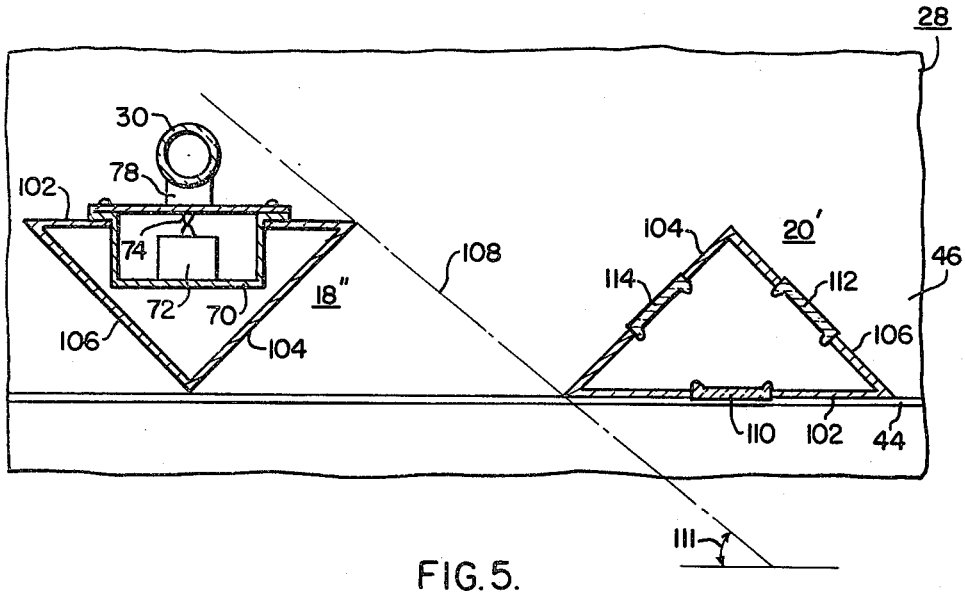
FIG. 5 is a fragmentary elevational view, in section, of a light-distributing ceiling structure constructed according to another embodiment of the invention.

FIG. 5 is a fragmentary, elevational view, similar to that of FIG. 2, illustrating reflector members 18'' and 20', which members are similar to reflector members 18 and 20, respectively, except for modifications made thereto according to additional embodiments of the invention. Reflector member 18'' includes first, second and third major sides or surfaces 102, 104 and 106, respectively, with the second and third sides 104 and 106 having like width dimensions, and with the first side 102 having a greater width dimension than the second and third sides, to define an isosceles triangle, instead of an equilateral triangle. This arrangement enables the spacing between adjacent reflector members to be increased, without exposing a direct view of the fluorescent tube 30, as illustrated by the flatter or smaller angle 111 of broken line 108 in FIG. 5, compared with angle 113 of broken line 96 in FIG. 2. FIG. 5 also illustrates that certain modifications may be made to the major sides of certain reflector members, such as by providing openings therein, with light-transmissive members 110, 112 and 114 being fixed in the openings. At least the light-transmissive member 110, which is viewable from the floor area below ceiling structure 10', is formed of a translucent material. Members 112 and 114 may be formed of transparent or translucent material, as desired. Members 110, 112 and 114 increase the amount of light transmitted to the floor area 11, without any direct lighting thereof.

In summary, there has been disclosed a new and improved light-distributing ceiling structure which provides indirect lighting for the area below. The new ceiling structure eliminates certain costly items conventionally used in the prior art, while providing a ceiling structure which is attractive from the aesthetic viewpoint. The drop ceiling, as it is conventionally used, is eliminated, as are the costly grids, plastic sheets, and the like, associated with drop ceilings. Simple, low cost, triangular-shaped reflector elements or members are mounted in spaced relation below a light-reflective ceiling, with alternate reflector members being inverted to provide a horizontal upper surface facing the ceiling. These horizontal surfaces function as support surfaces for light sources, with each surface so selected being modified to accept a fluorescent lighting fixture, or the modification may be such that the reflector member itself functions as a fluorescent lighting fixture. The reflector members are spaced from one another such that the fluorescent tubes are not directly viewable from any position below the ceiling structure.

I claim:

1. An indirect light-distributing ceiling structure for illuminating a floor area below, comprising:

a light-reflective ceiling, a plurality of elongated reflector members having longitudinal axes, said reflector members having first, second and third major side portions having first, second and third major surfaces, respectively, which define a substantially triangular cross-sectional configuration, said reflector members being disposed below said light-reflective ceiling, in horizontally spaced-parallel relation with one another, with one of the major surfaces of alternate reflector members being horizontally oriented and facing the light-reflective ceiling, and with one of the major surfaces of the intervening reflector members being horizontally oriented and facing the floor area below, and a source of light mounted on the ceiling facing major surface of at least one of said alternate reflectors such that said source is not directly viewable from the floor area.

2. The ceiling structure of claim 1 wherein the source of light includes a support member having a pair of lamp holders mounted on one side thereof, a fluorescent tube mounted in the lamp holders having a longitudinal axis parallel with the longitudinal axes of the reflector members, and a ballast member mounted on the other side of the support member, and wherein said support member forms at least a portion of the ceiling facing major surface of an alternate reflector member, with the ballast member being enclosed within the triangular cross-sectional configuration of the reflector member.

3. The ceiling structure of claim 1 wherein at least the intervening reflector members include translucent portions for transmitting light through the reflector member to the floor area to be illuminated, in addition to reflecting light to the floor area from its remaining surfaces.

4. The ceiling structure of claim 1 wherein the first, second and third sides of the reflector members are formed of metallic sheet material, with their outer surfaces being light reflective.

5. The ceiling structure of claim 1 wherein the first, second and third sides of the reflector members are of equal width, to define an equilateral triangle in cross-sectional configuration.

6. The ceiling structure of claim 1 wherein the substantially triangular cross-sectional configuration defines an isosceles triangle, with the second and third sides having like width dimensions, and the first side having a different width dimension.

7. The ceiling structure of claim 1 including first and second spaced support bracket members fixed to the ceiling having horizontally oriented flange portions which support the ends of the reflector members.

8. The ceiling structure of claim 1 wherein the major surfaces defined by the facing sides of adjacent reflector members are in spaced parallel planes, non-perpendicular to the horizontal floor area to be illuminated.

9. The ceiling structure of claim 1 wherein the source of light mounted on the ceiling facing major surface of at least one of the alternate reflector members is an uncovered fluorescent tube, with the light from the fluorescent tube being reflected from the ceiling and from the reflector members, to the floor area below the reflector members, and wherein the reflector members are directly viewable from the floor area.

* * * * *